US006132478A

United States Patent [19]

Tsurui et al.

[11] Patent Number: 6,132,478

[45] Date of Patent: Oct. 17, 2000

[54] COAL-WATER SLURRY PRODUCING PROCESS, SYSTEM THEREFOR, AND SLURRY TRANSFER MECHANISM

[75] Inventors: Masao Tsurui; Masanori Asakura; Takashi Goto; Tsutomu Katagiri, all of Yokohama; Akio Furuta, Handa; Takao Takinami, Handa; Yoshinori Suto, Handa; Kazuhiro Shibata, Sayama; Jin Ogawa, Tokyo; Masayuki Yui, Iwaki; Shinji Takano, Yokohama, all of Japan

[73] Assignee: JGC Corporation, Tokyo, Japan

[21] Appl. No.: 08/957,462

[22] Filed: Oct. 24, 1997

[30] Foreign Application Priority Data

| | | | |
|---|---|---|---|
| Oct. 25, 1996 | [JP] | Japan | 8-301213 |
| Dec. 10, 1996 | [JP] | Japan | 8-346727 |
| Apr. 14, 1997 | [JP] | Japan | 9-111881 |

[51] Int. Cl.[7] ..... C10L 1/32

[52] U.S. Cl. ..... 44/280; 44/620

[58] Field of Search ..... 44/280, 620

[56] References Cited

U.S. PATENT DOCUMENTS

| | | | |
|---|---|---|---|
| 4,104,035 | 8/1978 | Cole et al. | 44/280 |
| 4,666,464 | 5/1987 | Najjar et al. . | |
| 4,887,383 | 12/1989 | Mathiesen et al. | 44/280 |
| 4,904,277 | 2/1990 | Najjar et al. | 44/280 |
| 5,290,324 | 3/1994 | Yokokawa et al. | 44/280 |
| 5,485,728 | 1/1996 | Dickinson | 60/648 |
| 5,599,356 | 2/1997 | Hashimoto et al. | 44/280 |
| 5,685,153 | 11/1997 | Dickinson et al. | 44/280 |

FOREIGN PATENT DOCUMENTS

| | | |
|---|---|---|
| 60-152597 | 8/1985 | Japan . |
| 2-25396 | 6/1990 | Japan . |

*Primary Examiner*—Jacqueline V. Howard
*Attorney, Agent, or Firm*—McDermott, Will & Emery

[57] ABSTRACT

In a coal-water slurry producing system, low grade coal is wet-ground to not greater than 3 mm in particle size to produce a ground coal slurry. An upgrading treatment is applied to the ground coal slurry under a pressurized hydrothermal atmosphere not less than 300° C. to produce an upgraded coal slurry. The upgraded coal slurry is subjected to a dehydration treatment to produce an upgraded coal cake and a filtrate. A final coal-water slurry is produced from the upgraded coal cake. The filtrate is recycled for producing the ground coal slurry. A slurry transfer mechanism is provided in the coal-water slurry producing system for ensuring a stable transfer of the upgraded coal slurry from a high-pressure slurry vessel to a low-pressure slurry vessel.

2 Claims, 12 Drawing Sheets

COAL-WATER SLURRY PRODUCING PROCESS, SYSTEM THEREFOR, AND SLURRY TRANSFER MECHANISM

BACKGROUND OF THE INVENTION

1. Field of the Invention

The present invention relates to a process of and a system for producing a high-concentration low rank coal-water slurry, and further relates to a slurry transfer mechanism included in the system.

2. Description of the Prior Art

Coal-water slurries are produced by adding water and additives to coal powder obtained by finely grinding coal. Since the coal-water slurry is in the form of fluid, handling thereof is easy. Further, the price of the high-concentration coal-water slurry per unit calorie is lower than a heavy oil or the like. Accordingly, attention has been paid thereto as a fuel replacing petroleum. The coal-water slurry is required to have a high concentration of 60 to 70 weight % of coal for good thermal decomposition and gasification and further for high transportation efficiency. If low grade coal, such as sub-bituminous coal or lignite, is used as a material of the coal-water slurry, since the low grade coal is highly hygroscopic and highly moist and includes lots of oxygen-containing hydrophilic groups, such as phenol or carboxyl groups, and thus is high in hydrophilicity on the surface thereof, it has been not easy to produce the high-concentration coal-water slurry.

Under these circumstances, technology has been proposed for improving the quality of the low grade coal to achieve the high productivity of the high-concentration coal-water slurry. For example, Japanese Second (examined) Patent Publication No. 5-76993 discloses a technique, wherein the low grade coal is heated to 180 to 450° C. using a high-temperature gas so as to be improved in quality, and then the improved coal is ground and mixed with water at a given concentration to be formed into a coal-water slurry. Japanese First (unexamined) Patent Publication No. 52-71506 discloses a technique, wherein the quality of solid fuel is improved under a pressurized hydrothermal (hot water) atmosphere at 300 to 700° F. and after the quality improvement, the improved fuel is adjusted to a given particle size distribution to obtain a slurry. Japanese First (examined) Patent Publication No. 60-152597 discloses a technique for accomplishing further quality improvement using additives as an example of quality improvement in a non-vaporization dehydrating process.

However, the present inventors have found that any of the foregoing conventional techniques can not achieve the high improvement in quality and thus is not sufficient for producing the high-concentration coal-water slurry. Further, no attention has been paid to the effective utilization of waste water generated upon production of the coal-water slurry, which, hence, still remains as an outstanding problem.

On the other hand, in the course of producing the coal-water slurry, it is necessary that a high-pressure slurry is transferred from a high-pressure slurry vessel to a low-pressure slurry vessel through a valve while reducing a pressure of the high-pressure slurry. However, since a pressure differential between the high-pressure slurry vessel and the low-pressure slurry vessel is large, a pressure drop generated at the valve is also large. Thus, the flow velocity of the slurry is high upon passing the valve to cause abrasion or erosion of the valve. If vaporization occurs upon pressure reduction, the erosion becomes more intense.

If the valve is subjected to abrasion to a certain degree, it may be necessary to exchange a worn part of the valve which is high-priced in general. Further, it takes much time for valve maintenance including an exchanging operation for the worn part.

SUMMARY OF THE INVENTION

Therefore, it is an object of the present invention to provide an improved process of producing a high-concentration coal-water slurry.

It is another object of the present invention to provide an improved system for producing a high-concentration coal-water slurry.

It is another object of the present invention to provide an improved slurry transfer mechanism for transferring a high-pressure coal-water slurry from a high-pressure slurry vessel to a low-pressure slurry vessel in a coal-water slurry producing system.

According to one aspect of the present invention, a process comprises the steps of: wet-grinding low grade coal to not greater than 3 mm in particle size to produce ground coal; applying an upgrading treatment to the ground coal under a pressurized hydrothermal atmosphere not less than 300° C. to produce upgraded coal; and producing a high-concentration coal-water slurry using the upgraded coal.

It may be arranged that the low grade coal is sub-bituminous coal, and the upgrading treatment is applied to the sub-bituminous coal for not less than 10 minutes.

It may be arranged that the low grade coal is lignite, and the upgrading treatment is applied to the lignite for not less than 20 minutes.

According to another aspect of the present invention, a system comprises: a first processing system for wet-grinding low grade coal to produce a ground coal slurry of particle size not greater than 3 mm; a second processing system for applying an upgrading treatment to the ground coal slurry under a pressurized hydrothermal atmosphere not less than 300° C. to produce an upgraded coal slurry; a third processing system for applying a dehydration treatment to the upgraded coal slurry to produce an upgraded coal cake and a filtrate, adding water and an additive to the upgraded coal cake and mixing them to produce a high-concentration coal-water slurry; and a fourth processing system for recycling the filtrate as water for producing the ground coal slurry.

It may be arranged that the second processing system comprises a heating mechanism for heating the ground coal slurry, and the fourth processing system comprises a burning mechanism for burning an organic component contained in the filtrate to be removed, and that an exhaust gas discharged from the burning mechanism is fed to the heating mechanism for heating the ground coal slurry.

It may be arranged that the first processing system comprises a wet grinder and a flotator arranged prior to the wet grinder, and that the filtrate produced in the third processing system is fed to the flotator for deashing the low grade coal using a foaming component in the filtrate.

According to another aspect of the present invention, a slurry transfer mechanism for transferring a high-pressure slurry from a high-pressure slurry vessel to a low-pressure slurry vessel while reducing a pressure of the high-pressure slurry, the high-pressure slurry obtained by applying an upgrading treatment to a ground coal-water slurry under a pressurized hydrothermal atmosphere, comprises: a first chamber provided downstream of the high-pressure slurry vessel and having a capacity smaller than that of the high-pressure slurry vessel; an intermediate pressure-reducing vessel provided downstream of the first chamber and below a slurry outlet of the first chamber; a second chamber provided between the intermediate pressure-reducing vessel and the low-pressure slurry vessel and below a slurry outlet of the intermediate pressure-reducing vessel and having a capacity smaller than that of the intermediate pressure-reducing vessel; a first control valve provided between the high-pressure slurry vessel and the first chamber; a second control valve provided between the first chamber and the intermediate pressure-reducing vessel; a third control valve provided between the intermediate pressure-reducing vessel and the second chamber; a fourth control valve provided between the second chamber and the low-pressure slurry vessel; and an equalizer pipe connecting between an upper portion of the first chamber and an upper portion of the intermediate pressure-reducing vessel and provided with a fifth control valve, wherein, through operations of the first to fourth control valves, the slurry in the high-pressure slurry vessel is transferred through the first chamber, the intermediate pressure-reducing vessel and the second chamber to the low-pressure slurry vessel while the pressure of the high-pressure slurry is reduced in turn, and wherein, when transferring the slurry from the first chamber to the intermediate pressure-reducing vessel, the fifth control valve is opened to equalize pressures in the first chamber and the intermediate pressure-reducing vessel to each other.

According to another aspect of the present invention, a slurry transfer mechanism for transferring a high-pressure slurry from a high-pressure slurry vessel to a low-pressure slurry vessel while reducing a pressure of the high-pressure slurry, the high-pressure slurry obtained by applying an upgrading treatment to a ground coal-water slurry under a pressurized hydrothermal atmosphere, comprises: a first chamber provided downstream of the high-pressure slurry vessel and having a capacity smaller than that of the high-pressure slurry vessel; an intermediate pressure-reducing vessel provided downstream of the first chamber and below a slurry outlet of the first chamber; a second chamber provided between the intermediate pressure-reducing vessel and the low-pressure slurry vessel and below a slurry outlet of the intermediate pressure-reducing vessel and having a capacity smaller than that of the intermediate pressure-reducing vessel; a first control valve provided between the high-pressure slurry vessel and the first chamber; a second control valve provided between the first chamber and the intermediate pressure-reducing vessel; a third control valve provided between the intermediate pressure-reducing vessel and the second chamber; a fourth control valve provided between the second chamber and the low-pressure slurry vessel; and an equalizer pipe connecting between an upper portion of the intermediate pressure-reducing vessel and an upper portion of the second chamber and provided with a fifth control valve, wherein, through operations of the first to fourth control valves, the slurry in the high-pressure slurry vessel is transferred through the first chamber, the intermediate pressure-reducing vessel and the second chamber to the low-pressure slurry vessel while the pressure of the high-pressure slurry is reduced in turn, and wherein, when transferring the slurry from the intermediate pressure-reducing vessel to the second chamber, the fifth control valve is opened to equalize pressures in the intermediate pressure-reducing vessel and the second chamber to each other.

According to another aspect of the present invention, a slurry transfer mechanism for transferring a high-pressure slurry from a high-pressure slurry vessel to a low-pressure slurry vessel while reducing a pressure of the high-pressure slurry, the high-pressure slurry obtained by applying an upgrading treatment to a ground coal-water slurry under a pressurized hydrothermal atmosphere, comprises: a vertical first chamber having a bottom located at an upper end of a branch passage which is branched upward from a pipe extending from the high-pressure slurry vessel, the first chamber having a capacity smaller than that of the high-pressure slurry vessel; an intermediate pressure-reducing vessel provided downstream of the branch passage along the pipe; a second chamber provided between the intermediate pressure-reducing vessel and the low-pressure slurry vessel and having a capacity smaller than that of the intermediate pressure-reducing vessel; a first control valve provided between the high-pressure slurry vessel and the first chamber; a second control valve provided between the first chamber and the intermediate pressure-reducing vessel; a third control valve provided between the intermediate pressure-reducing vessel and the second chamber; and a fourth control valve provided between the second chamber and the low-pressure slurry vessel; wherein, through operations of the first to fourth control valves, the slurry in the high-pressure slurry vessel is transferred through the first chamber, the intermediate pressure-reducing vessel and the second chamber to the low-pressure slurry vessel while the pressure of the high-pressure slurry is reduced in turn.

According to another aspect of the present invention, a slurry transfer mechanism for transferring a high-pressure slurry from a high-pressure slurry vessel to a low-pressure slurry vessel while reducing a pressure of the high-pressure slurry, the high-pressure slurry obtained by applying an upgrading treatment to a ground coal-water slurry under a pressurized hydrothermal atmosphere, comprises: a vertical first chamber having a bottom located at an upper end of a branch passage which is branched upward from a pipe extending from the high-pressure slurry vessel, the first chamber having a capacity smaller than that of the high-pressure slurry vessel; an intermediate pressure-reducing vessel provided downstream of the branch passage along the pipe and below the bottom of the first chamber; a second chamber provided between the intermediate pressure-reducing vessel and the low-pressure slurry vessel and below a slurry outlet of the intermediate pressure-reducing vessel, and having a capacity smaller than that of the intermediate pressure-reducing vessel; a first control valve provided between the high-pressure slurry vessel and the first chamber; a second control valve provided between the first chamber and the intermediate pressure-reducing vessel; a third control valve provided between the intermediate pressure-reducing vessel and the second chamber; and a fourth control valve provided between the second chamber and the low-pressure slurry vessel; a first equalizer pipe connecting between an upper portion of the first chamber and an upper portion of the intermediate pressure-reducing vessel and provided with a fifth control valve; and a second equalizer pipe connecting between an upper portion of the intermediate pressure-reducing vessel and an upper portion of the second chamber and provided with a sixth control valve, wherein, through operations of the first to fourth control valves, the slurry in the high-pressure slurry vessel is transferred through the first chamber, the intermediate pressure-reducing vessel and the second chamber to the low-pressure slurry vessel while the pressure of the high-pressure slurry is reduced in turn, wherein, when transferring the slurry from the first chamber to the intermediate pressure-reducing vessel, the fifth control valve is opened to equalize pressures in the first chamber and the intermediate pressure-reducing vessel to each other, and wherein, when transferring the slurry from the intermediate pressure-reducing vessel to the second chamber, the sixth control valve is opened to equalize pressures in the intermediate pressure-reducing vessel and the second chamber to each other.

According to another aspect of the present invention, a slurry transfer mechanism for transferring a high-pressure slurry from a high-pressure slurry vessel to a low-pressure slurry vessel while reducing a pressure of the high-pressure slurry, the high-pressure slurry obtained by applying an upgrading treatment to a ground coal-water slurry under a pressurized hydrothermal atmosphere, comprises: a valve provided between the high-pressure slurry vessel and the low-pressure slurry vessel for opening/closing a slurry flow passage therebetween; and a restrictor portion where the slurry flow passage is once reduced and then increased in cross section, the restrictor portion provided downstream of the valve, wherein the high-pressure slurry is transferred to an inlet of the restrictor portion in a liquid phase and subjected to a pressure drop at the restrictor portion.

It may be arranged that the valve is controlled to be opened when a slurry level in the high-pressure slurry vessel reaches a first level and closed after a lapse of a given time or when the slurry level reaches a second level lower than the first level.

It may be arranged that an emergency shutoff valve is provided between the high-pressure slurry vessel and the valve.

BRIEF DESCRIPTION OF THE DRAWINGS

The present invention will be understood more fully from the detailed description given hereinbelow, taken in conjunction with the accompanying drawings.

In the drawings.

DESCRIPTION OF THE PREFERRED EMBODIMENT

Now, preferred embodiments of the present invention will be described hereinbelow.

Figure 1:
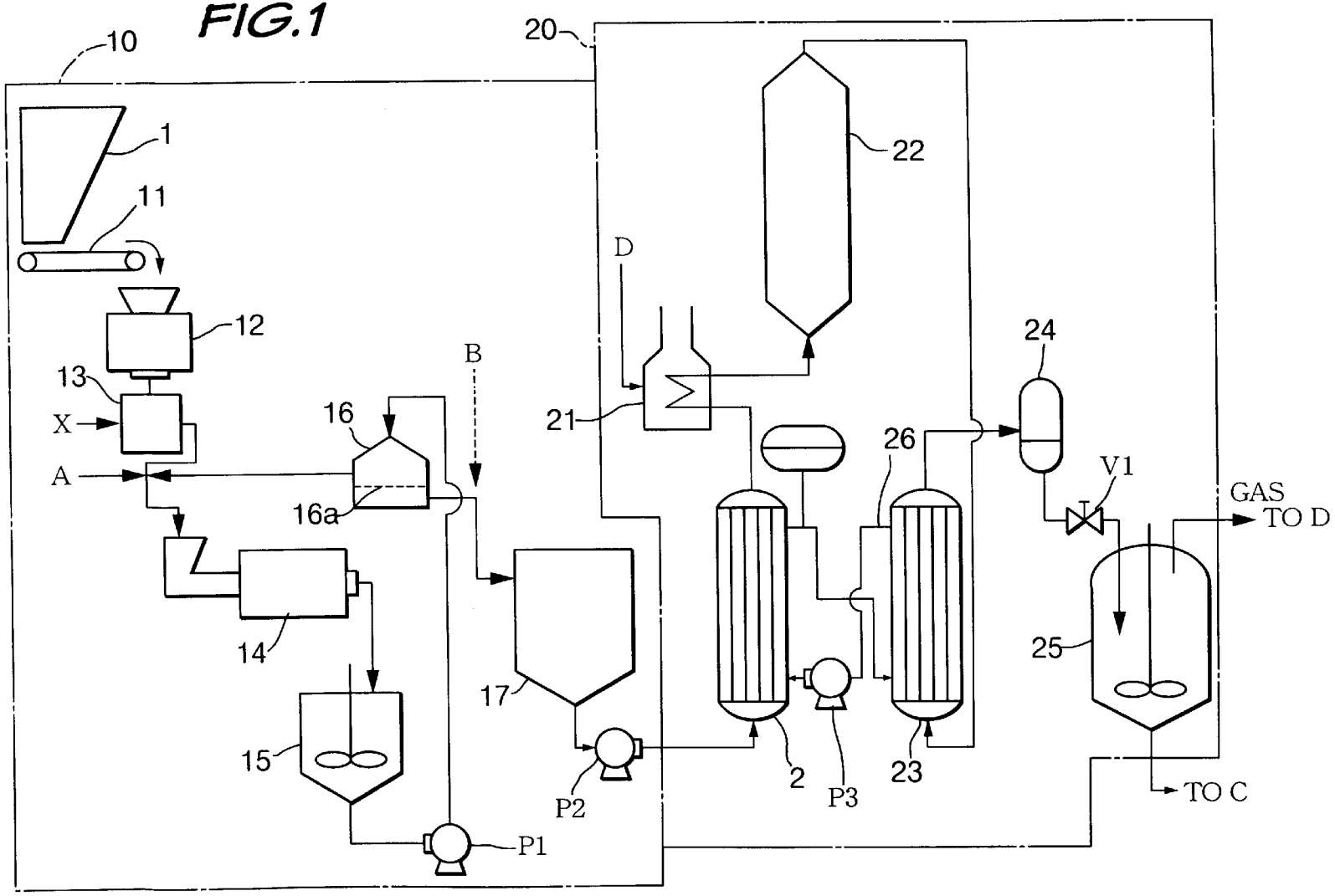
FIGS. 1 and 2 are diagrams schematically showing the overall structure of a high-concentration coal-water slurry producing system according to a first preferred embodiment of the present invention.
Figure 2:
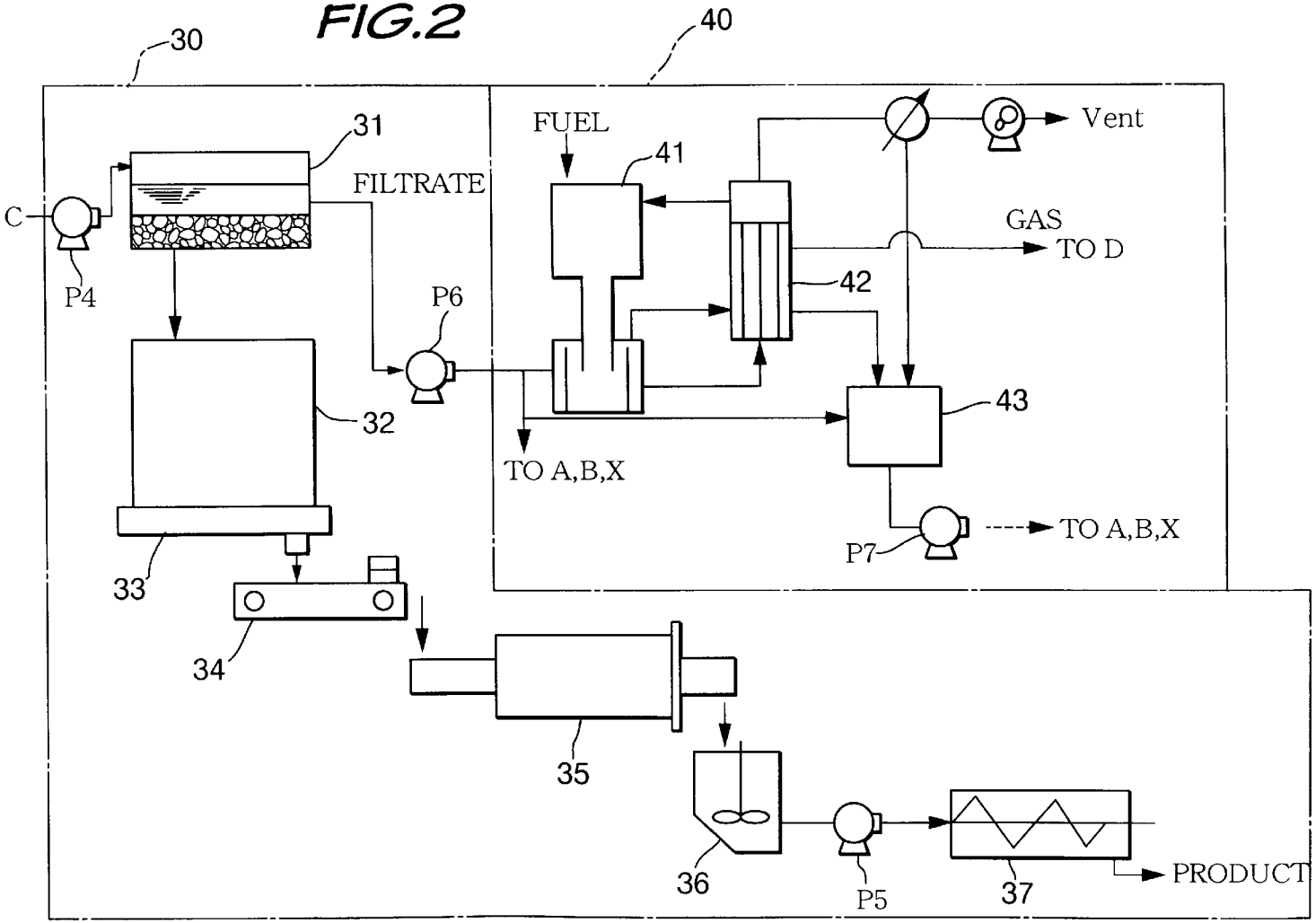

FIGS. 1 and 2 schematically show the overall structure of a high-concentration coal-water slurry producing system according to a first preferred embodiment of the present invention. The high-concentration coal-water slurry producing system comprises a prior-upgrading processing system 10, an upgrading system 20, a slurry product finalizing system 30 and a waste water recycling system 40. In the prior-upgrading processing system 10, low grade coal is wet-ground to obtain a ground coal slurry. Then, in the upgrading system 20, the ground coal slurry is improved in quality or upgraded under later-described conditions. Then, in the slurry product finalizing system 30, the ground coal slurry after upgrading (upgraded coal slurry) is subjected to a dehydration treatment so as to be separated into an upgraded coal cake and a filtrate, and subsequently, water and an additive are added to and mixed with the upgraded coal cake to obtain a high-concentration coal-water slurry product. Further, in the waste water recycling system 40, the filtrate is returned to the prior-upgrading processing system 10 and recycled as process water.

Now, each of the foregoing systems will be described in detail.

(Prior-Upgrading Processing System)

In the prior-upgrading processing system 10, low rank coal, such as sub-bituminous coal or lignite, put in a raw coal hopper 1 is supplied to a rough grinder 12 via a feeder 11 and roughly ground. When ash contents are large, the roughly ground coal is fed to a flotator 13 where the roughly ground coal adheres to foams contained in water so that sand and stones sink to be removed. In this embodiment, the filtrate, containing foaming components, which is generated in the upgrading section 30 is returned from the waste water recycling system 40 to be used as the water for the flotator 13. After flotation treatment, the roughly ground coal is sent to a wet grinder 14 along with the filtrate from the waste water recycling section 40. In the wet grinder 14, the roughly ground coal is wet-ground to not greater than 3 mm in particle size, preferably not greater than 1 mm so that a ground coal slurry is obtained. The ground coal slurry is then stored in a ground coal slurry storage vessel 15.

Thereafter, the ground coal slurry is sent to a classifier 16 by means of a pump P1. In the classifier 16, the ground coal having the particle size exceeding 3 mm is classified by a mesh sieve 16*a* and returned to the wet grinder 14 for further grinding. On the other hand, the ground coal slurry of particle size not greater than 3 mm is added with water or the filtrate from the waste water recycling system 40 and sent to a feed slurry storage vessel 17. The filtrate is added to the ground coal slurry so as to provide, for example, a 25 weight % ground coal slurry in the feed slurry storage vessel 17.

(Upgrading System) In the upgrading system 20, the prior-upgrading slurry (ground coal slurry) from the feed slurry vessel 17 is sent to a slurry preheater 2 by means of a pump P2. In the slurry preheater 2, the prior-upgrading slurry is pressurized and heated to, for example, 150° C. Then, in a slurry heater 21, the prior-upgrading slurry is heated to, for example, 300° C. and fed to an upgrading reactor 22. In the upgrading reactor 22, liquid components (water) in the ground coal slurry become hot water of 300° C., and the ground coal is kept in contact with the hot water so that the quality of the ground coal is improved. In the upgrading reactor 22, the reaction advances for a given time in a pressurized hydrothermal (hot water) atmosphere.

Thereafter, the upgraded coal slurry is cooled in a slurry cooler 23 and sent to a gas-liquid separator (high-pressure slurry vessel) 24 for gas-liquid separation. Then, the upgraded coal slurry is fed to an upgraded coal slurry storage vessel (low-pressure slurry vessel) 25 via a valve V1. Between the slurry preheater 2 and the slurry cooler 23, heat transfer medium circulation passages 26 are provided so that a heat transfer medium is circulated therebetween by means of a pump P3 to utilize the heat of the high-temperature slurry fed to the slurry cooler 23 for preheating the slurry in the slurry preheater 2. In this embodiment, as a high-temperature gas used in the slurry heater 21, a waste gas obtained from the upgraded coal slurry vessel 25 upon pressure reduction and subjected to an incineration treatment in a furnace of the heater 21 and/or a portion of high-temperature exhaust gas generated in the waste water recycling system 40 are used. The heater 21 may use direct heating instead of indirect heating for heating the prior-upgrading slurry.

(Slurry Product Finalizing System)

In the slurry product finalizing system 30, as shown in FIG. 2, the upgraded coal slurry sent from the upgraded coal slurry vessel 25 by means of a pump P4 is subjected to a dehydration treatment in a dehydrator 31 to be separated into an upgraded coal cake and a filtrate. The upgraded coal cake is once stored in an upgraded coal hopper 32 and then fed to a quantitative coal feeder 34 via a feeder 33. The quantitative coal feeder 34 feeds the upgraded coal cake to a kneader or mixer 35 in fixed quantity. The mixer 35 is further supplied with an additive and water and mix them with the upgraded coal cake to produce a high-concentration coal-water slurry. The high-concentration coal-water slurry is once stored in a storage vessel 36 and then further sent to a kneader or mixer 37 by means of a pump P5 so as to be finalized as a coal-water slurry product. On the other hand, the filtrate separated by the dehydrator 31 is sent to the waste water recycling system 40.

(Waste Water Recycling System)

In the waste water recycling system 40, organic substances, such as BOD components, COD components and phenol concentrated in the filtrate are oxidized (burned) and condensed in a submerged combustion furnace 41 and a condenser 42 so as to be removed from the filtrate or waste water. In this system, pH of the waste water is adjusted according to necessity. The filtrate free of the organic substances is once recovered into a recovered water storage vessel 43 and then fed to the flotator 13, the wet grinder 14 and the feed slurry vessel 17, as described before, by means of a pump P7. The filtrate may also be fed to the flotator 13, the wet grinder 14 and the feed slurry vessel 17, as described before, directly by means of a pump P6. On the other hand, the high-temperature exhaust gas discharged from the condenser 42 fed to the slurry heater 21 for heating the ground coal slurry as described before.

In this embodiment, the raw coal is ground to not greater than 3 mm in particle size and then subjected to the hydrothermal treatment. Thus, fine pores on the surface of the raw coal are collapsed to reduce a specific surface area, and carboxyl and hydroxyl groups bonded on the surface, which is a cause of hygroscopicity, are partly removed, so that the upgraded coal becomes hydrophobic. As a result, the upgraded coal is irreversibly dehydrated and, since the specific surface area is reduced to allow less adhering water, inherent moisture is reduced and hygroscopicity is lowered. Accordingly, as appreciated from later-described examples, the high-concentration coal-water slurry having a preferable viscosity (about 1,000 cp at 25° C.) can be produced.

Further, in this embodiment, the organic components, such as COD, BOD and phenol, in the filtrate separated from the upgraded ground coal slurry are burned (oxidized) to be removed, and the filtrate free of the organic components is recycled as process water in the prior-upgrading processing system 10. Thus, the unit cost of the coal-water slurry can be reduced to render the system economical and, since the organic components are removed from coal, the non-harmful coal-water slurry can be obtained. Further, the drainage of the waste water containing the organic components can be suppressed, thereby contributing to the environmental sanitation. Moreover, since the foaming components in the filtrate are utilized for the flotator 13 in the prior-upgrading processing system 10, deashing and desulfurizing can be carried out economically. Even if the filtrate from the dehydrator 31 is directly recycled as process water in the prior-upgrading processing system 10, the unit cost of the coal-water slurry can also be lowered.

EXAMPLE

In each of Examples 1 to 4, Berau coal (Indonesian sub-bituminous coal) was used as raw coal. The raw coal was wet-ground to not greater than 3 mm in particle size to obtain a ground coal slurry of 35 weight % solid concentration. The ground coal slurry was subjected to a hydrothermal treatment (upgrading treatment: hot-water drying treatment) at about 300° C. for not less than 10 minutes using an autoclave of 1 liter content volume. Inherent moisture of an upgraded coal cake after a dehydration treatment was measured. Then, a moisture adjustment of the upgraded coal cake was carried out to obtain a coal-water slurry of 1,000 cp viscosity, and a solid concentration of the obtained coal-water slurry was measured. The results are shown in Table 1. Evaluation was performed based on a simple measurement method so as to be indicated as good when the solid concentration was not less than 60.0 weight %. In case of Example 4 (particle size: 2,000 to 3,000 μm), the solid concentration was slightly lower than those obtained in Examples 1 to 3 where the particle sizes were smaller.

In Comparative Example 1, a feed slurry was not upgraded, but subjected to a moisture adjustment to obtain a coal-water slurry. In Comparative Examples 2 and 3, the raw coal was wet-ground to greater than 3,000 μm. Inherent moistures of coal cakes and solid concentrations of coal-water slurries were measured as in Examples 1 to 4. The results are shown in Table 1. As seen from Table 1, it is necessary that the particle size of the ground coal be not greater than 3 mm.

TABLE 1

| | feed slurry | | upgrading condition | | | |
|---|---|---|---|---|---|---|
| | solid con. (wt %) | parti. size (μm) | temp. (° C.) | pressure (kg/cm$^2$) | time (min) | evaluation |
| ex. 1 | 35 | 105–500 | 302 | 124 | 13 | O |
| ex. 2 | 35 | 500–1000 | 307 | 118 | 10 | O |
| ex. 3 | 35 | 1000–2000 | 307 | 124 | 10 | O |
| ex. 4 | 35 | 2000–3000 | 306 | 124 | 10 | O |
| cmp ex. 1 | — | 105–1000 | — | — | — | X |
| cmp ex. 2 | 35 | 3000–4760 | 307 | 124 | 10 | X |
| cmp ex. 3 | 35 | 4760–9520 | 306 | 125 | 10 | X |

In each of Examples 11–13, 21–23 and 31–33, Adaro coal (Indonesian sub-bituminous coal), Asamasam coal (Indonesian sub-bituminous coal) or Loyyang coal (Australian lignite) was used as raw coal. The raw coal was wet-ground to not greater than 3 mm in particle size to obtain a ground coal slurry of 35 weight % solid concentration. The ground coal slurry was subjected to a hydrothermal treatment (upgrading treatment) not less than 3000° C. for not less than 10 minutes.

In each of Comparative Examples 10, 11, 21, 31 and 32, the ground coal slurry was subjected to a similar hydrothermal treatment at 270° C.

In each of Examples and Comparative Examples, inherent moisture of an upgraded coal cake after a dehydration treatment was measured. Then, a moisture adjustment of the upgraded coal cake was carried out to obtain a coal-water slurry of 1,000 cp viscosity, and a solid concentration of the obtained coal-water slurry was measured. The results are shown in Table 2. Evaluation was performed based on a simple measurement method so as to be indicated as good when the solid concentration was not less than 62.5 weight % in case of the sub-bituminous coal, and not less than 57.5 weight % in case of the lignite.

TABLE 2

| | raw coal | upgrading condition temp. (° C.) | pressure (kg/cm$^2$) | time (min) | evaluation |
|---|---|---|---|---|---|
| cmp ex. 10 | sub- | 270 | 80 | 40 | X |
| cmp ex. 11 | bituminous | 270 | 80 | 60 | X |
| ex. 11 | coal | 300 | 135 | 10 | O |
| ex. 12 | Adaro | 300 | 110 | 30 | O |
| ex. 13 | | 330 | 150 | 10 | O |
| cmp ex. 21 | sub- | 270 | 135 | 60 | X |
| ex. 21 | bituminous | 300 | 135 | 10 | O |
| ex. 22 | coal | 300 | 150 | 30 | O |
| ex. 23 | Asamasam | 330 | 150 | 10 | O |
| cmp ex. 31 | | 270 | 135 | 30 | X |
| cmp ex. 32 | lignite | 300 | 150 | 10 | X |
| ex. 31 | Loyyang | 300 | 150 | 20 | O |
| ex. 32 | | 300 | 135 | 30 | O |
| ex. 33 | | 330 | 150 | 10 | O |

As seen from Table 2, by applying the hydrothermal treatment to the raw coal not less than 300° C., the solid concentration of the coal-water slurry becomes not less than 62.5 weight % or 57.5 weight %, and thus the high-concentration coal-water slurry can be obtained. Accordingly, by carrying out the hydrothermal treatment not less than 300° C., the low grade coal, which has not been used, can be used as fuel. Although there is no particular upper limit of the temperature, it is preferably not higher than 330° C. in view of cost. The pressure in the upgrading reactor 22 was determined by adding 15 Kg/cm$^2$ to a saturated vapor pressure at that temperature.

It has been found through various experiments carried out by the present inventors that, if the residence time (upgrading time) is not less than 10 minutes, the surface of the raw coal becomes hydrophobic and the high-concentration coal-water slurry of solid concentration not less than 60 weight % can be reliably obtained. However, in case of the lignite, it is preferable that the process time is about 30 minutes, while not less than 20 minutes may be acceptable. As appreciated, even in those cases, it is necessary that the particle size of the raw coal be not greater than 3 mm. Under these conditions, the moisture in the coal is discharged to largely lower the inherent moisture.

Calorific values were measured about the coal-water slurries obtained in Example 11 and Comparative Example 10, respectively. The results were 4,500 Kcal/Kg for the former and 4,200 Kcal/Kg for the latter, which showed superiority of the coal-water slurry as a fuel.

Now, a second preferred embodiment of the present invention will be described with reference to FIGS. 3 to 9.

In the foregoing first preferred embodiment, the high-pressure slurry is transferred from the gas-liquid separator (high-pressure slurry vessel) 24 to the upgraded coal slurry storage vessel (low-pressure slurry vessel) 25 via the valve V1. However, since a pressure differential between the high-pressure slurry vessel 24 and the low-pressure slurry vessel 25 is large, a pressure drop generated at the valve V1 is also large. Thus, the flow velocity of the slurry is high upon passing the valve V1 to cause abrasion or erosion of the valve V1. If vaporization occurs upon pressure reduction, the erosion becomes more intense. If the valve V1 is subjected to erosion to a certain degree, it may be necessary to exchange a worn part of the valve V1 which is high-priced in general.

The second preferred embodiment aims to improve the slurry transfer from the high-pressure slurry vessel 24 to the low-pressure slurry vessel 25 in the first preferred embodiment.

Figure 3:
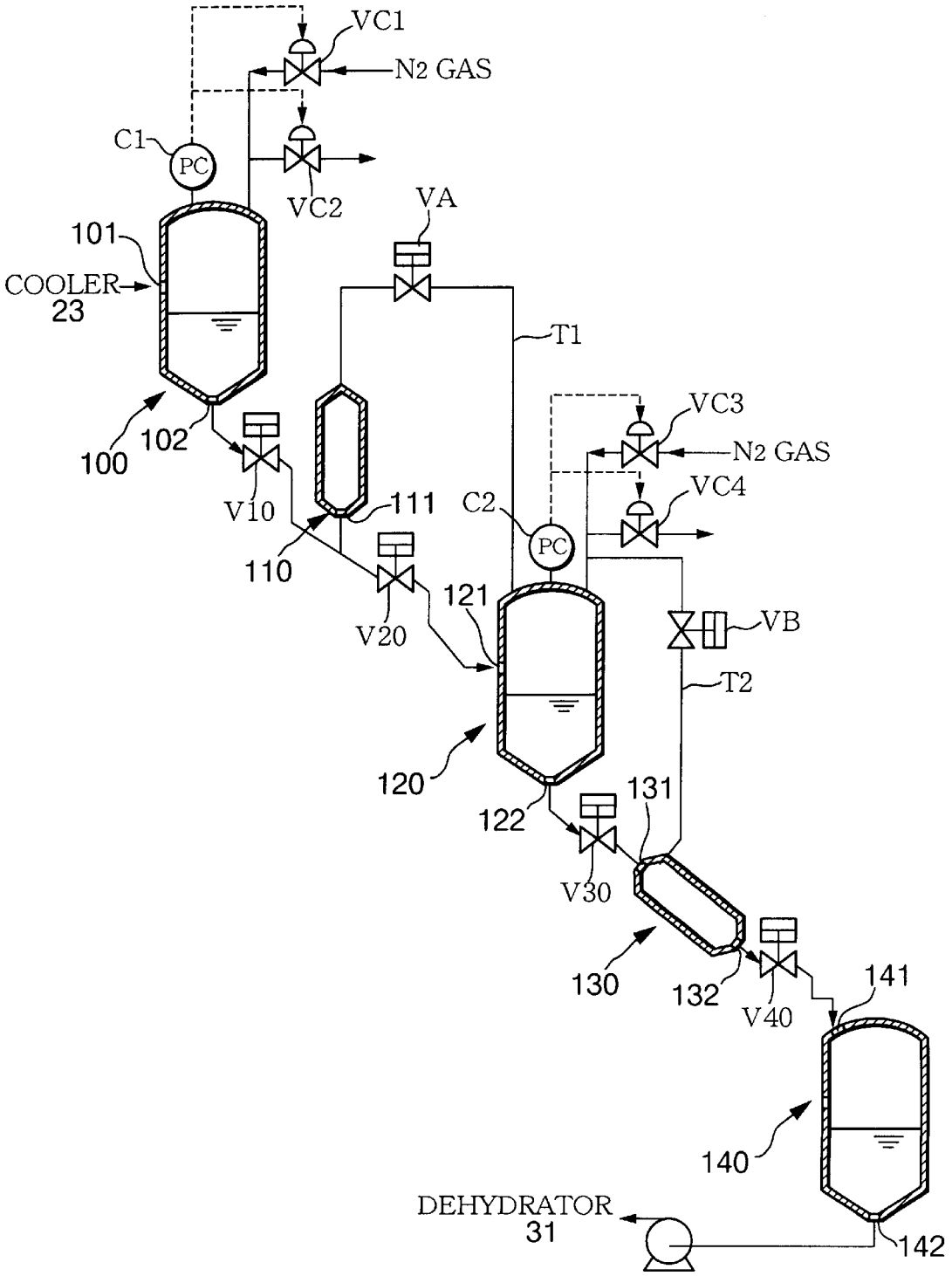
FIG. 3 is a diagram schematically showing a slurry transfer mechanism according to a second preferred embodiment of the present invention.

FIG. 3 shows a slurry transfer mechanism for replacing the slurry transfer mechanism of the first preferred embodiment, that is, a portion of the upgrading system 20 from the high-pressure slurry vessel 24 to the low-pressure slurry vessel 25.

In FIG. 3, numeral 100 denotes a high-pressure slurry vessel in the form of a gas-liquid separator which just corresponds to the high-pressure slurry vessel (gas-liquid separator) 24 in the first preferred embodiment. The high-pressure slurry vessel 100 has a slurry inlet 101 and a slurry outlet 102. Based on detection values of a pressure control unit C1, a pressurized inert gas, such as nitrogen or air, is fed into the high-pressure slurry vessel 100 via a pressure control valve VC1 or the inert gas is vented from the high-pressure slurry vessel 100 via a pressure control valve VC2, so that the pressure of the high-pressure slurry in the high-pressure slurry vessel 100 is controlled.

Downstream of the high-pressure slurry vessel 100 is arranged a vertical first chamber 110. Specifically, the first chamber 110 has a bottom located at an upper end of a branch passage which is branched upward from a pipe extending from the high-pressure slurry vessel 100. As the capacity of the first chamber 110 becomes smaller, the pressure fluctuation during transfer of the slurry is reduced. Accordingly, it is preferable that the first chamber 110 is smaller in capacity than the high-pressure slurry vessel 100. Particularly, it is preferable that the capacity of the first chamber 110 is not greater than 1/20 times that of the high-pressure slurry vessel 100. The first chamber 110 has a slurry output 111 at the bottom thereof. Further, control valves V10 and V20 are disposed at upstream and downstream sides of the first chamber 110, respectively.

Downstream of the control valve V20 is arranged an intermediate pressure-reducing vessel 120. The intermediate vessel 120 has a slurry inlet 121 and a slurry outlet 122 at a side and a bottom thereof, respectively. The slurry inlet 121 is arranged below the slurry outlet 111 of the first chamber 110. Further, an upper portion of the intermediate vessel 120 and an upper portion of the first chamber 110 are connected via a first equalizer pipe T1. A control valve VA is arranged, for example, at an uppermost position of the first equalizer pipe T1. Similar to the high-pressure slurry vessel 100, based on detection values of a pressure control unit C2, a pressurized inert gas, such as nitrogen or air, is fed into the intermediate vessel 120 via a pressure control valve VC3 or the inert gas is vented from the intermediate vessel 120 via a pressure control valve VC4, so that the pressure of the slurry in the intermediate vessel 120 is controlled.

Downstream of the intermediate vessel 120 is provided a second chamber 130 via a control valve V30. The second chamber 130 has a slurry inlet 131 and a slurry outlet 132 at a top and a bottom thereof, respectively. The slurry inlet 131 is arranged below the slurry outlet 122 of the intermediate vessel 120. The second chamber 130 is arranged in a slant attitude along a slurry transfer path so that the slurry outlet 132 is located below the slurry inlet 131. It is preferable that the second chamber 130 is smaller in capacity than the intermediate vessel 120 for preventing the pressure fluctuation. Particularly, it is preferable that the capacity of the second chamber 130 is not greater than 1/20 times that of the intermediate vessel 120. An upper portion of the second chamber 130 and an upper portion of the intermediate vessel 120 are connected by a second equalizer pipe T2. A control valve VB is disposed, for example, at an uppermost position of the second equalizer pipe T2.

Downstream of the second chamber 130 is arranged a low-pressure slurry vessel 140 via a control valve V40. The low-pressure slurry vessel 140 just corresponds to the low-pressure slurry vessel 25 in the first preferred embodiment. The low-pressure slurry vessel 140 has a slurry inlet 141 and a slurry outlet 142 at a top and a bottom thereof. The slurry inlet 141 is arranged below the slurry outlet 132 of the second chamber 130.

Now, an operation of the foregoing slurry transfer mechanism will be described with reference to FIGS. 4 to 9.

Figure 4:
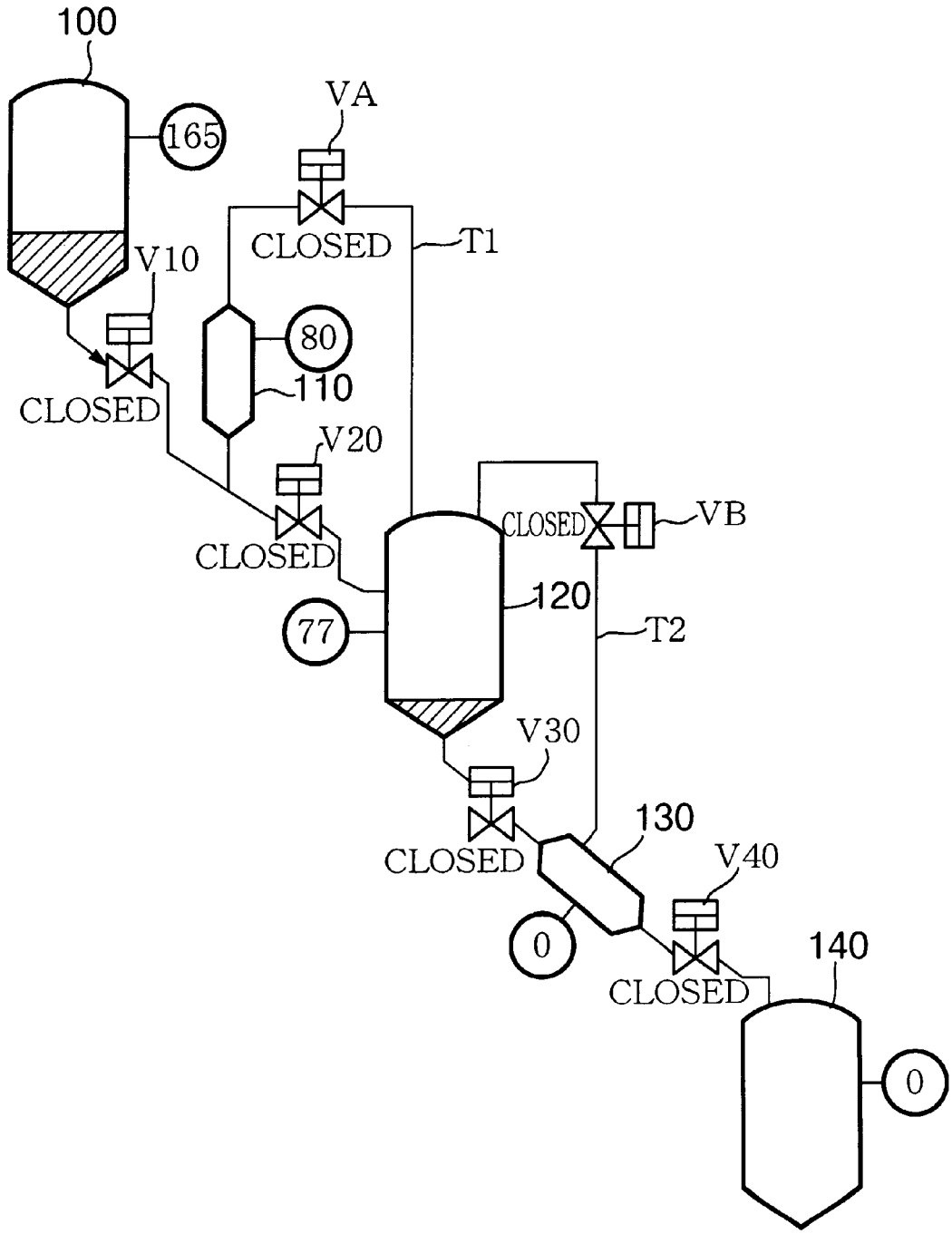
FIGS. 4 to 9 are diagrams for explaining an operation of the slurry transfer mechanism shown in FIG. 3.

FIG. 4 shows a state before the start of a slurry transfer process (pressure reducing process), wherein the high-pressure slurry vessel 100 includes, for example, 44 liters of the high-pressure coal-water slurry transferred from the cooler 23 (see FIG. 1). In this state, the pressures in the high-pressure slurry vessel 100, the first chamber 110, the intermediate pressure-reducing vessel 120, the second chamber 130 and the low-pressure slurry vessel 140 are 165 kg/cm$^2$, 80 kg/cm$^2$, 77 kg/cm$^2$, 0 kg/cm$^2$ and 0 kg/cm$^2$, respectively, and the control valves V10, V20, V30, V40, VA and VB are closed, as indicated in FIG. 4.

The control valve V10 is controlled to be open and closed when the liquid level (slurry level) reaches predetermined levels, respectively. It is so arranged that the slurry always remains in the high-pressure slurry vessel 100. On the other hand, the control valves V20, V30, V40, VA and VB are controlled by a valve controller (not shown) on a time basis.

Figure 5:
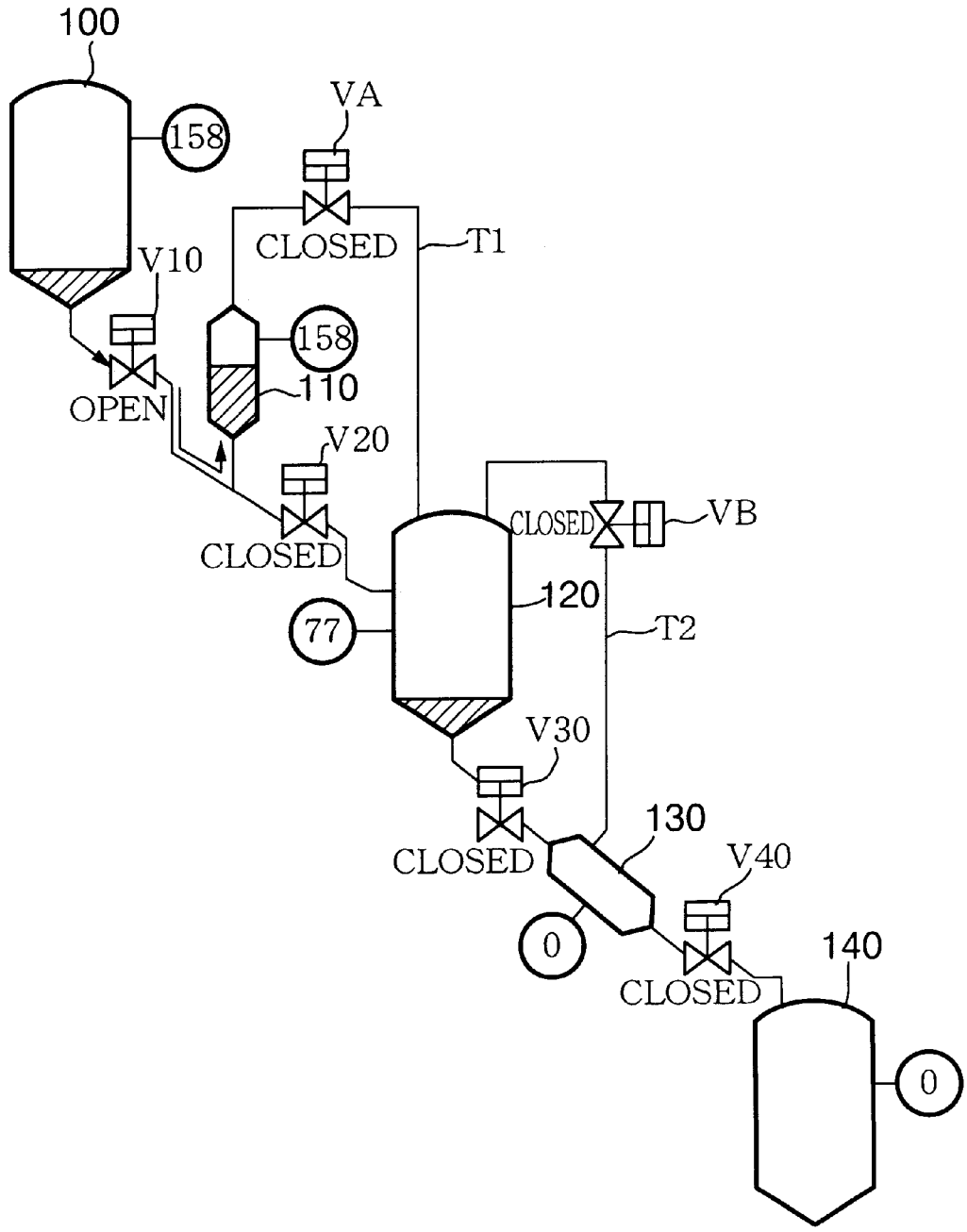

When the control valve V10 is first opened as shown in FIG. 5, since the initial pressures in the high-pressure slurry vessel 100 and the first chamber 110 are 165 kg/cm$^2$ and 80 kg/cm$^2$, respectively, 20 liters, for example, of the high-pressure slurry in the high-pressure slurry vessel 100 is sucked into the first chamber 110 due to a pressure differential therebetween so that both pressures reach the same value (158 kg/cm$^2$). The pressures in the high-pressure slurry vessel 100 and the first chamber 110 are determined by the volumes of the pipes, the vessel 100 and the first chamber 110.

Figure 6:
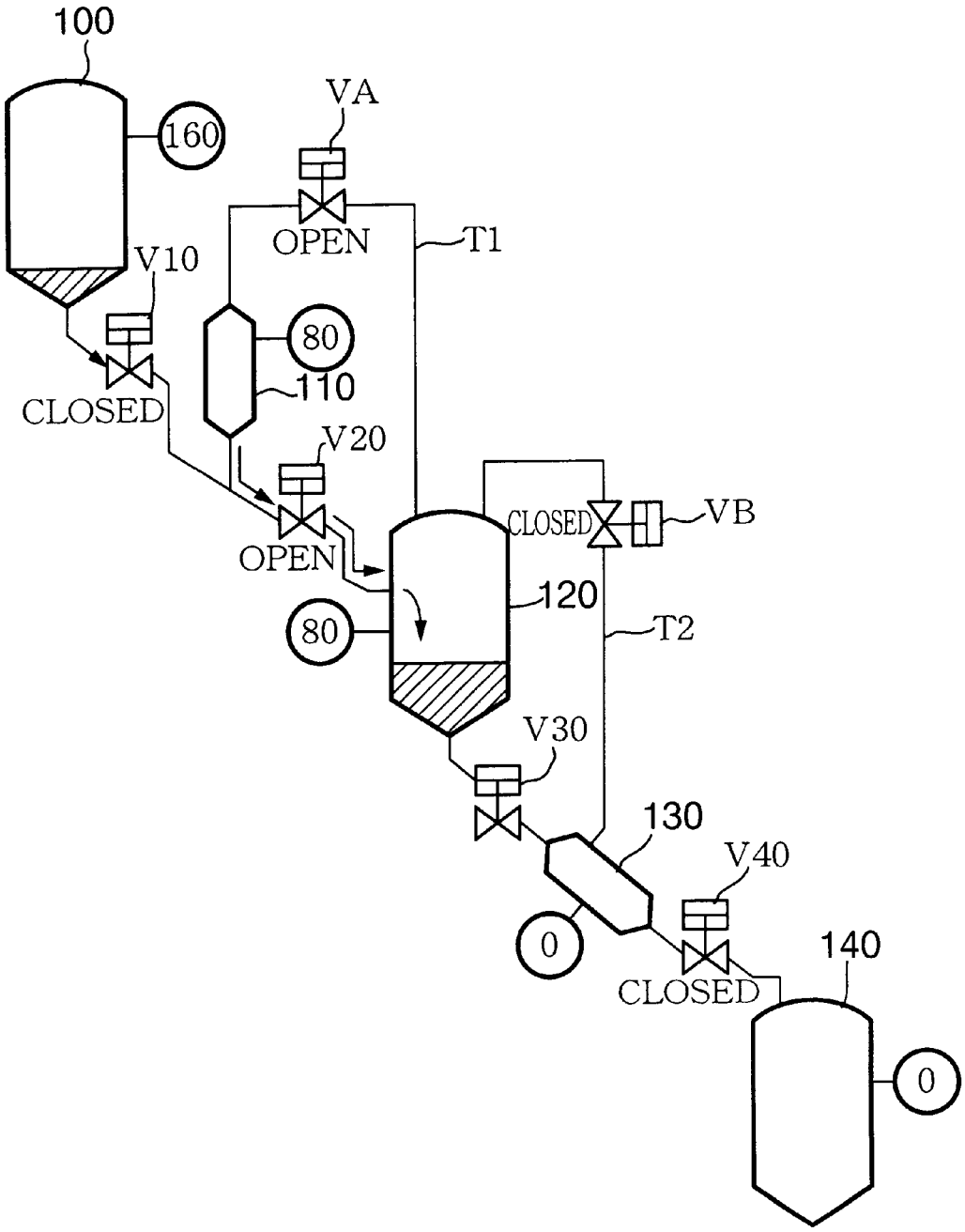

Then, when the control valve V10 is closed and the control valve V20 is opened as shown in FIG. 6, the slurry in the first chamber 110 is forced out into the intermediate vessel 120 due to the energy of the high-pressure gas of 158 kg/cm$^2$ in the first chamber 110. Thus, the pressure in the first chamber 110 is reduced while the pressure in the intermediate vessel 120 is increased. Since the bottom of the first chamber 110 is located at the upper end of the foregoing branch passage which is branched upward from the pipe extending from the high-pressure slurry vessel 100 and further since the first chamber 110 is vertically arranged, the liquid (slurry) is smoothly forced out by the gas, and thus the gas is prevented to a large extent from breaking through the liquid (slurry) to enter the intermediate vessel 120, thereby preventing the slurry from remaining in the first chamber 110. If, on the other hand, the first chamber 110 is arranged horizontally, it is possible that the gas goes ahead of the liquid (slurry) to cause the slurry to remain in the first chamber 110.

Subsequently, when the valve VA is opened as shown in FIG. 6, the gas in the first chamber 110 flows into the intermediate vessel 120 via the first equalizer pipe T1 so that both pressures reach the same value (80 kg/cm$^2$). Hence, even if the slurry remains in the first chamber 110, the slurry in the first chamber 110 slowly falls into the intermediate vessel 120 due to the gravity. Thus, the slurry can be reliably drawn out from the first chamber 110 so that the slurry is prevented from remaining in the first chamber 110 or the downstream pipe. If, on the other hand, the equalizer pipe T1 is not provided, it is possible that the gas breaks through the slurry and flows into the intermediate vessel 120 so that the pressure in the first chamber 110 temporarily becomes lower than that in the intermediate vessel 120. This disables the slurry from falling down by the gravity and thus causes the slurry to remain.

Figure 7:
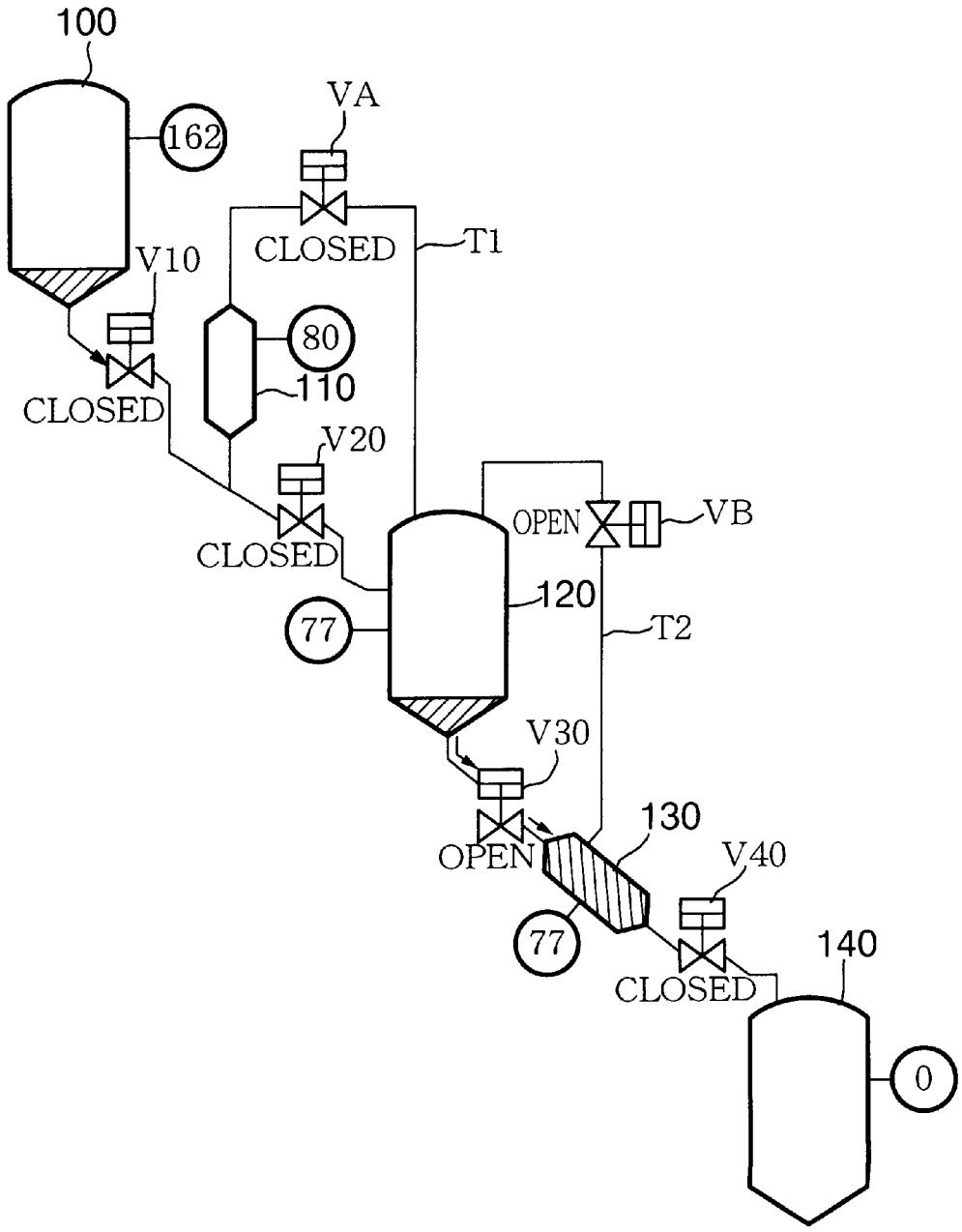

Then, the control valve VB is opened as shown in FIG. 7, the gas in the intermediate vessel 120 flows into the second chamber 130 via the second equalizer pipe T2. Thus, the pressure in the intermediate vessel 120 is reduced from 80 kg/cm2 to 77 kg/cm2 while the pressure in the second chamber 130 is increased from 0 kg/cm2 to 77 kg/cm2, that is, both pressure reach the same value.

When the control valve V30 is opened subsequently, since the second chamber 130 is located below the intermediate vessel 120, the slurry in the intermediate vessel 120 falls into the second chamber 130 due to the gravity. While the second chamber 130 may be arranged slantly, horizontally or vertically, it is preferable to arrange it vertically for suppressing the gas from staying in the second chamber 130 after transfer of the slurry from the intermediate vessel 120 to the second chamber 130.

The reason for equalizing the pressures in the intermediate vessel 120 and the second chamber 130 by the second equalizer pipe T2 is as follows: If the second equalizer pipe T2 is not provided, since a pressure differential between the intermediate vessel 120 and the second chamber 130 is large, that is, about 80 kg/cm$^2$, at the control valve V30 upon transfer of the slurry from the intermediate vessel 120 to the second chamber 130 and further since the pressure in the intermediate vessel 120 is about 80 kg/cm$^2$, vaporization of water in the slurry occurs downstream of the control valve V30 immediately upon transfer of the slurry. On the other hand, as the transfer of the slurry advances so that the pressure in the second chamber 130 becomes not less than a saturation pressure of the slurry, the vaporization does not occur.

As a result, the gas is generated in the transferred slurry in the form of bubbles so that a frictional force is increased due to an expansion force of the gas. Accordingly, when the slurry passes through the control valve V30, it is possible that the control valve V30 is subjected to abrasion. On the other hand, if the second equalizer T2 is provided, the pressures in the intermediate vessel 120 and the second chamber 130 become equal to each other before the transfer of the slurry to prevent a pressure drop at the control valve V30. Thus, since a possibility that a portion of the slurry changes into the gas during the transfer is prevented, the erosion of the control valve V30 can be suppressed.

Figure 8:
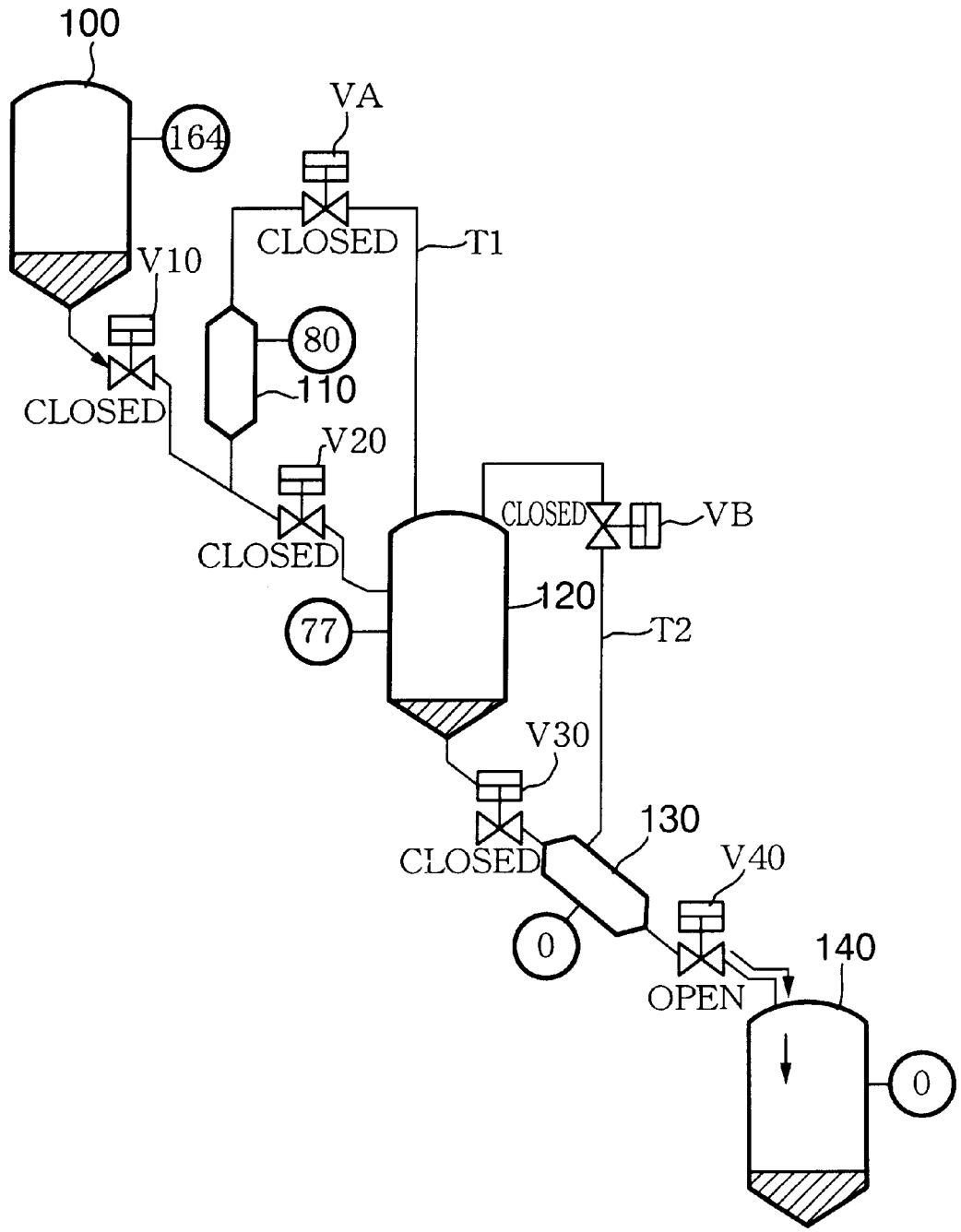
Figure 9:
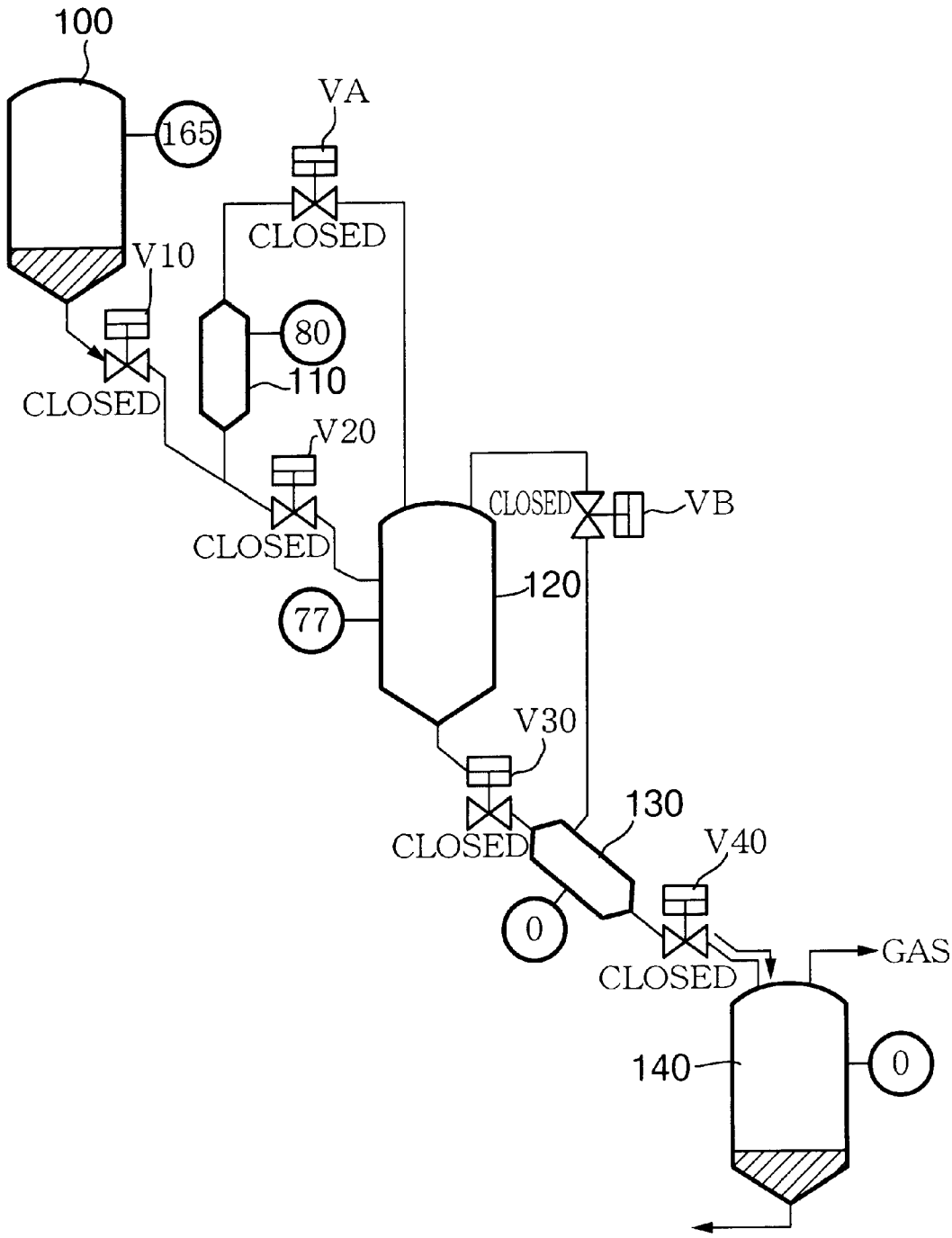

After the transfer of the slurry from the intermediate vessel 120 to the second chamber 130, the control valves V30 and VB are closed and the control valve V40 is opened as shown in FIG. 8 so that the slurry is transferred from the second chamber 130 to the low-pressure slurry vessel 140. As a result, the pressure in the second chamber 130 is reduced from 77 kg/cm$^2$ to 0 kg/cm$^2$, that is, the pressure in the low-pressure slurry vessel 140. Then, as shown in FIG. 9, the control valve V40 is closed so that the transfer of the slurry from the high-pressure slurry vessel 100 to the low-pressure slurry vessel 140 is finished. Subsequently, the low-pressure slurry vessel 140 is exposed to the atmospheric pressure by venting through a gas exhaust pipe (not shown), and then the slurry is sent to the dehydrator 31 by means of the pipe P4 (see FIG. 2).

According to the foregoing slurry transfer mechanism, since the first equalizer pipe T1 is provided, the slurry can be fully transferred from the first chamber 110 to the intermediate vessel 120 so as to prevent the slurry from remaining just upstream of the control valve V20. Thus, the stable transfer of the slurry can be achieved. Further, since the control valves VA and VB are disposed essentially at the uppermost positions of the first and second equalizer pipes T1 and T2, respectively, choking of the control valves VA and VB due to the coal splashing during transfer can be prevented.

Further, since the second equalizer pipe T2 is provided, the slurry flows by its weight so that the flow velocity of the slurry across the control valve V30 is small, and further, the vaporization of water during the transfer of the slurry is prevented. Accordingly, the erosion of the control valve V30 can be prevented. A pressure differential across the control valve V10 is large, that is, about 85 kg/cm$^2$. However, since the temperature in the high-pressure slurry vessel 100 is low (170° C.) while the pressure is high, the vapor pressure in the vessel 100 is low. Accordingly, even if the pressure in the vessel 100 is reduced during the transfer of the slurry, vaporization of water in the slurry does not occur. Further, since the temperature for upgrading is set to a value not higher than a saturated vapor temperature corresponding to the minimum pressure of 158 kg/cm$^2$ of the vessel 100, an occurrence of vapor generation is not possible. Accordingly, since the slurry passes through the control valve V10 in the form of liquid, the erosion of the control valve V10 can be suppressed to some extent.

A pressure differential across the control valve V20 is large, that is, about 81 kg/cm$^2$. However, similar to the control valve V10, since the high-pressure slurry is cooled to a temperature at which vaporization does not occur under the operating pressure of the intermediate vessel 120, the slurry passes through the control valve V20 in the form of liquid so that the erosion of the control valve V20 can also be suppressed to some extent. As described, since the erosion of the control valves V10 to V30 can be suppressed to some extent, the duration of these control valves can be prolonged.

In this preferred embodiment, the control valve VA is opened after the control valve V20 is opened and when the pressures in the high-temperature slurry vessel 100 and the first chamber 110 becomes essentially equal to each other. Although the two-step pressure reduction is carried out, that is, the pressure reduction from the high-pressure slurry vessel 100 to the intermediate vessel 120 and the pressure reduction from the intermediate vessel 120 to the low-pressure slurry vessel 140, more than two-step pressure reduction may be carried out for pressure reduction from the high-pressure slurry vessel 100 to the low-pressure slurry vessel 140. In this case, a plurality of the intermediate vessels 120 as well as the associated members are provided between the high-pressure slurry vessel 100 and the low-pressure slurry vessel 140.

Now, a third preferred embodiment of the present invention will be described with reference to FIGS. 10 to 14.

The third preferred embodiment aims to improve the slurry transfer from the high-pressure slurry vessel 24 to the low-pressure slurry vessel 25 in the first preferred embodiment with a simpler structure as compared with the second preferred embodiment.

Figure 10:
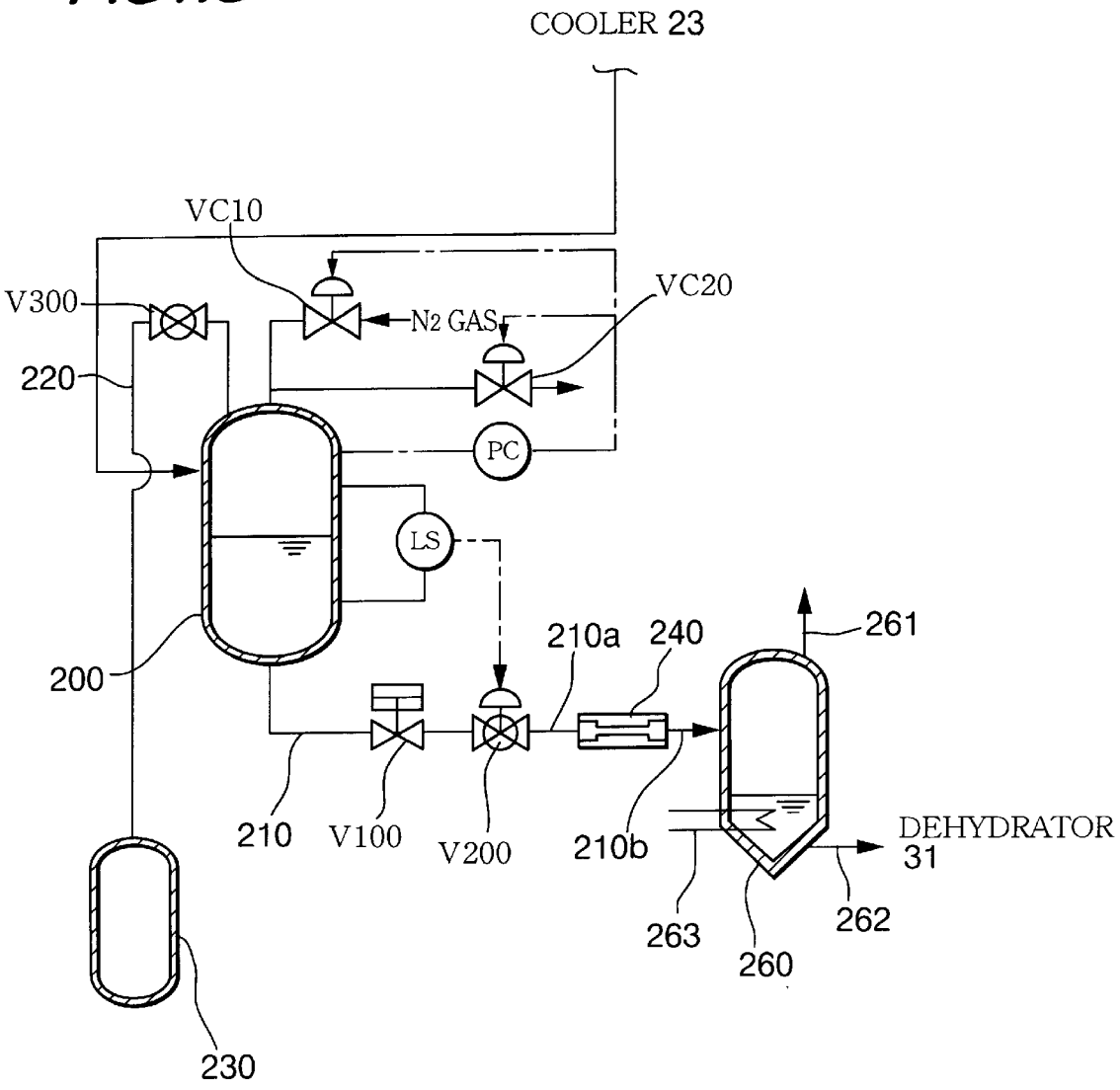
FIG. 10 is a diagram schematically showing a slurry transfer mechanism according to a third preferred embodiment of the present invention.

FIG. 10 shows a slurry transfer mechanism for replacing the slurry transfer mechanism of the first preferred embodiment, that is, a portion of the upgrading system 20 from the high-pressure slurry vessel 24 to the low-pressure slurry vessel 25.

In FIG. 10, numeral 200 denotes a high-pressure slurry vessel in the form of a gas-liquid separator which just corresponds to the high-pressure slurry vessel (gas-liquid separator) 24 in the first preferred embodiment. Based on detection values of a pressure control unit PC, a pressurized inert gas, such as nitrogen or air, is fed into the high-pressure slurry vessel 200 via a pressure control valve VC10 or the inert gas is vented from the high-pressure slurry vessel 200 via a pressure control valve VC20, so that the pressure of the high-pressure slurry in the high-pressure slurry vessel 200 is controlled.

Downstream of the high-pressure slurry vessel 200 is arranged a pipe 210 of carbon steel for transferring the slurry therethrough. The pipe 210 is provided with an emergency shutoff valve V100 and a control valve V200 in this order toward a downstream side. The control valve V200 is in the form of, for example, a ball valve and is controlled to be opened or closed based on a differential level gauge LS which is provided to the high-pressure slurry vessel 200.

The emergency shutoff valve V100 is normally open while it is closed upon emergency, for example, when the control valve V200 is held open due to failure, so as to prevent the slurry from flowing into a low-pressure slurry vessel 260 without control. The low-pressure slurry vessel 260 just corresponds to the low-pressure slurry vessel 25 in the first preferred embodiment. The emergency shutoff valve V100 is controlled based on, for example, the liquid (slurry) level or the pressure in the high-pressure slurry vessel 200 and closed upon detection of, for example, a rapid lowering of the liquid level in the high-pressure slurry vessel 200.

A pressure drop generated during transfer of the slurry from the high-pressure slurry vessel 200 to a downstream side of the control valve V200 is represented by the sum of a pressure drop generated at the pipe 210 and a pressure drop generated at the control valve V200. An inner diameter and a length of the pipe 210 and a shape of the control valve V200 are so set as to achieve a small value of the foregoing pressure drop sum, that is, for example, not greater than 5 kg/cm2, where vaporization of the slurry does not occur.

Figure 11:
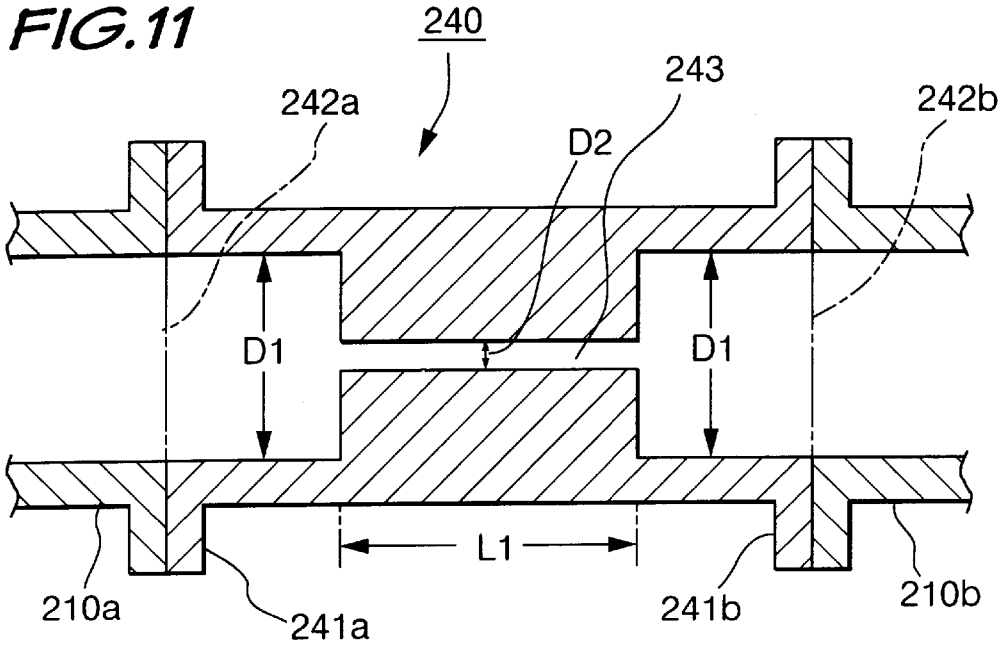
FIG. 11 is a sectional view showing a flow restrictor portion of the slurry transfer mechanism shown in FIG. 10.

A flow restrictor portion 240 is detachably provided in a pipe downstream of the control valve V200. As shown in FIG. 11, the restrictor portion 240 has flange portions 241*a* and 241*b* at upstream and downstream ends (inlet and outlet) 242*a* and 242*b* thereof. The flange portion 241*a* is coupled to a flange portion of a pipe 210*a* arranged upstream of the restrictor portion 240, while the flange portion 241*b* is coupled to a flange portion of a pipe 210*b* arranged downstream of the restrictor portion 240.

An inner diameter D1 of the upstream end 242*a* of the restrictor portion 240 is set equal to an inner diameter of the pipe 210*a*. The downstream end 242*b* of the restrictor portion 240 also has the inner diameter D1 which is equal to an inner diameter of the pipe 210*b*. The restrictor portion 240 includes a narrowed portion 243 having upstream and downstream ends spacing a given distance from the upstream end 242*a* and the downstream end 242*b*, respectively. The narrowed portion 243 has an inner diameter D2 and a length L1 which are determined such that a pressure drop at the restrictor portion 240 becomes essentially equal to a pressure differential between the high-pressure slurry vessel 200 and the low-pressure slurry vessel 260.

Figure 12:
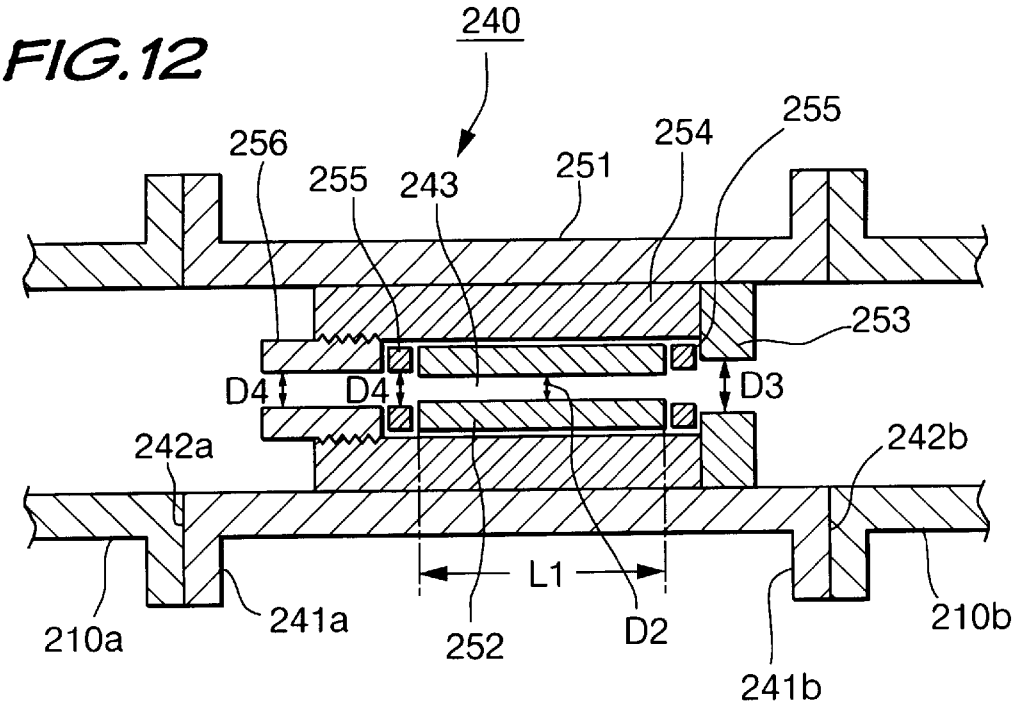
FIG. 12 is a sectional view showing a modification of the flow restrictor portion shown in FIG. 11.

FIG. 12 shows a modification of the restrictor portion 240 in the third preferred embodiment. A restrictor portion 240 in this modification includes a pipe 251 of carbon steel to which flanges 241*a* and 241*b* are welded. A ceramic tubular narrowing member (restrictor) 252, which forms a narrowing portion 243, is fixed inside the pipe 251. The narrowing member 252 has an inner diameter D2 and a length L1.

In the neighborhood of a downstream end 242*b* of the pipe 251, a ring-shaped stopper 253 having an inner diameter D3 is disposed in the pipe 251. The outer periphery of the stopper 253 is welded to the inner periphery of the pipe 251.

Upstream of the stopper 253, a tubular member 254 is disposed along the inner periphery of the pipe 251. The tubular member 254 has an inner diameter greater than an outer diameter of the narrowing member 252 and a length greater than the length L1 of the narrowing member 252. A downstream end surface of the tubular member 254 is welded to an upstream end surface of the stopper 253. Inside the tubular member 254, the narrowing member 252 is provided, and further, a pair of rings 255 each made of Teflon and having an inner diameter D4 are arranged at upstream and downstream sides of the narrowing member 252. At an upstream end of the tubular member 254, a tubular screw member 256 having the inner diameter D4 is engaged with the inner periphery of the tubular member 254.

The stopper 253, the tubular member 254 and the screw member 256 are made of carbon steel. The inner diameter D3 of the stopper 253 and the inner diameters D4 of the rings 255 and the screw member 256 are set larger than the inner diameter D2 of the narrowing member 252, while the inner diameter D3 of the stopper 253 is set smaller than the outer diameter of the narrowing member 252. By screwing the screw member 253 into the tubular member 254, a downstream end surface of the narrowing member 252 is pressed upon the upstream end surface of the stopper 253 via the ring 255 so that the narrowing member 252 is fixed inside the pipe 251. The ring 255 and the screw member 256 may have different inner diameters as long as they are smaller than the inner diameter D2 of the narrowing member 252.

Figure 13:
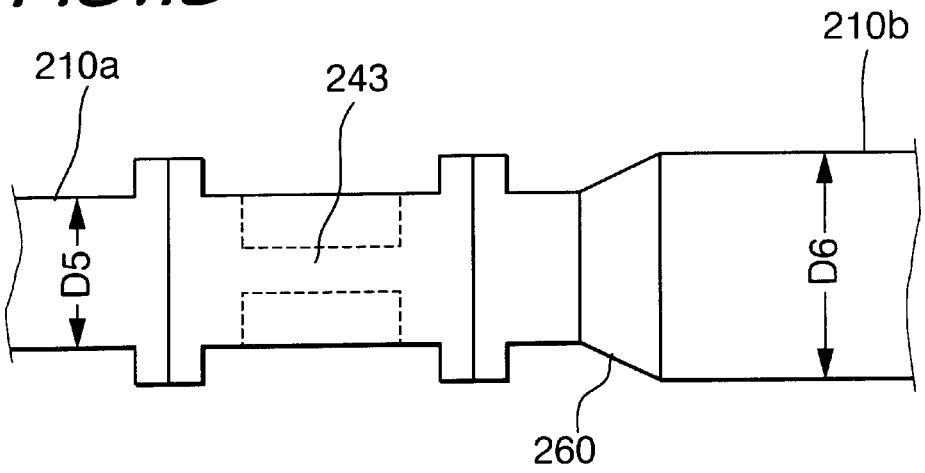
FIG. 13 is a diagram showing a modification of the flow restrictor portion shown in FIG. 11 or 12.

FIG. 13 shows a modification of the restrictor portion 240 in the third preferred embodiment or the foregoing modification. In this modification, a downstream pipe 210*b* has a reducer 260 so as to gradually increase an inner diameter of the pipe 210*b* from a position spacing a given distance from an upstream end of the pipe 210*b* where the pipe 210*b* is coupled to the flow restrictor portion 240. This is preferable particularly when vaporization of the slurry occurs after pressure reduction. Specifically, when vaporization of the slurry occurs, bubbles are generated to increase the volume thereof. In this case, if the inner diameter of the pipe is constant, the flow velocity of the slurry increases to enlarge a possibility of erosion of the pipe. In view of this, the inner diameter of the pipe 210*b* is gradually increased to suppress such a possibility. As an example, an inner diameter D5 of an upstream pipe 210*a* and an inner diameter D6 of the downstream pipe 210*b* are 4 inches and 6 inches, respectively. The reducer 260 may be of a concentric type or an eccentric type, and may be provided upstream or downstream of the restrictor portion 240.

Referring back to FIG. 10, the low-pressure slurry vessel 260 for temporarily storing the slurry of the atmospheric pressure is provided downstream of the flow restrictor portion 240. The low-pressure slurry vessel 260 is provided at an upper portion thereof with an exhaust passage 261 for venting the gas and at a lower portion thereof with a pipe 262 for transferring the slurry to the dehydrator 31 (see FIG. 2). A cooler 263 may be provided for cooling the slurry. In this embodiment, an upper portion of the high-pressure slurry vessel 200 is connected to a cushion drum 230 via a pipe 220. A control valve V300 in the form of a ball valve is provided at the uppermost portion of the pipe 220 for opening and closing a passage to the cushion drum 230.

Now, an operation of the foregoing slurry transfer mechanism will be described hereinbelow.

When the slurry level in the high-pressure slurry vessel 200, as detected by the differential level gauge LS, reaches a first level, the control valve V200 is controlled to be opened. After a lapse of a given time or when the slurry level reaches a second level lower than the first level, the control valve V200 is controlled to be closed. The operation of the control valve V200 is controlled so that the slurry always exists in the high-pressure slurry vessel 200 for preventing the gas from entering the pipe 210.

In the foregoing manner, the given amount of the slurry is transferred to the restrictor portion 240 via the emergency shutoff valve V100 and the control valve V200. It may be arranged that the control valve V300 is opened at this time so as to vent the gas in the vessel 200 to the cushion drum 230 for suppressing the pressure fluctuation of the gas in the vessel 200.

Since the pressure drop generated during the transfer of the slurry from the high-pressure slurry vessel 200 to the downstream side of the control valve V200 is small as described before, the slurry is transferred to the downstream side of the control valve V200 in the liquid phase. Specifically, although the pressure drop of the slurry is generated during the transfer to the downstream side of the control valve V200, since the pressure drop is small, vaporization of the slurry does not occur so that the slurry can pass through the control valve V200 in the liquid phase.

Then, the slurry passes through the restrictor portion 240. As described above, since the passage in the restrictor portion 240 is large in cross section at the inlet, then reduced at the narrowing portion 243 and then again increased at the outlet. Accordingly, a pressure drop generated from the narrowing portion 243 to the outlet is large. For example, when the pressure at the inlet of the restrictor portion 240 is about 135 $kg/cm^2$ G, the pressure at the outlet becomes about 2 $kg/cm^2$ G.

After passing the restrictor portion 240, the slurry is transferred to the low-pressure slurry vessel 260 where the gas is vented via the exhaust passage 261 so that the slurry is reduced in pressure to the atmospheric pressure. The slurry is temporarily stored in the low-pressure slurry vessel 260 and then transferred to the dehydrator 31.

According to the foregoing third preferred embodiment, the pressure drop is set to be large at the restrictor portion 240 so as to reduce the pressure drop generated at the pipe 210 and the control valve V200. Thus, the slurry can be transferred to the downstream side of the control valve V200 in the liquid phase and then largely reduced in pressure at the restrictor portion 240. As a result, since the slurry passes through the control valve V200 at the flow velocities in the range where the erosion is not liable to occur, an occurrence of the erosion can be suppressed. This prolongs the duration of the control valve V200. Further, since the pressure drop at the control valve V200 is small, the control valve V200 may have a simple structure, such as a ball valve.

On the other hand, the pressure drop at the restrictor portion 240 is large so that the flow velocity of the slurry through the restrictor portion 240 is high. Thus, an abrasion force of the slurry is increased to cause the erosion. In this case, it is necessary to exchange the restrictor portion 240. Since the restrictor portion 240 is detachably provided, the exchange is easy. Further, a troublesome disassembling operation as required for the control valve V200 is not necessary. Moreover, since the restrictor portion 240 is simpler in structure as compared with the control valve V200, it is less expensive. Accordingly, even if the exchange of the restrictor portion 240 becomes necessary, the operation is easier and the cost can be reduced as compared with the exchange of the control valve V200.

Further, according to the third preferred embodiment, since it is necessary to provide only the emergency shutoff valve V100, the control valve V200 and the restrictor portion 240 between the high-pressure slurry vessel 200 and the low-pressure slurry vessel 260, the slurry transfer mechanism is simple in structure and easy to control.

Figure 14:
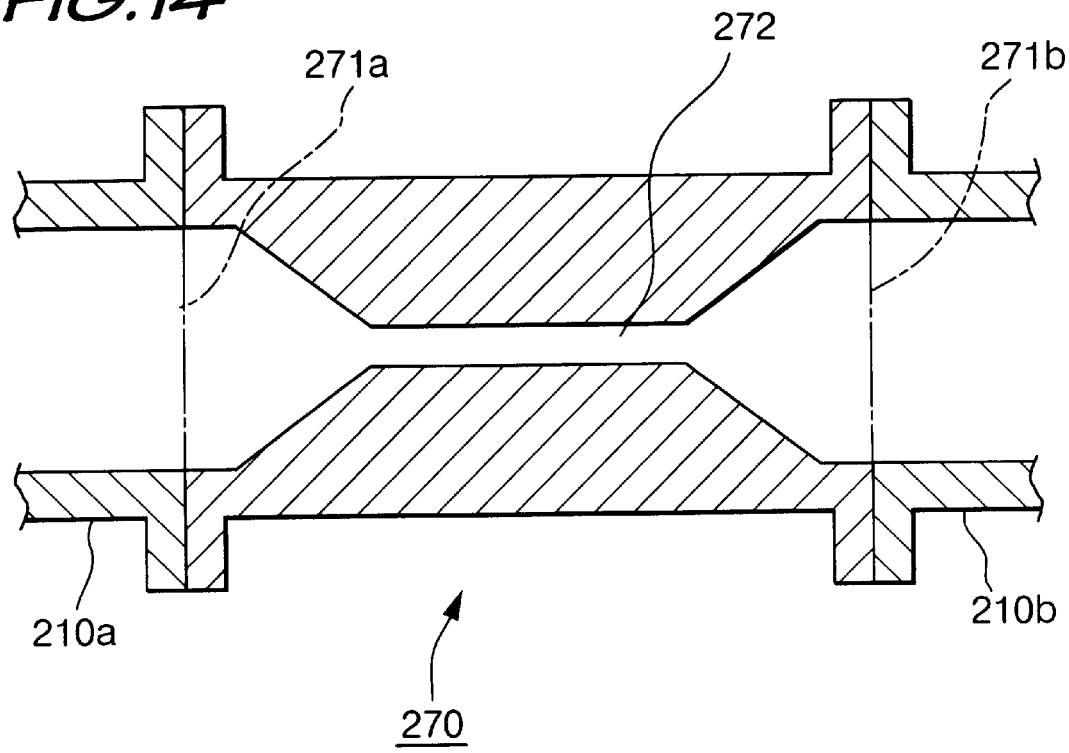
FIG. 14 is a sectional view showing a further modification of the flow restrictor portion shown in FIG. 11.

FIG. 14 shows a further modification of the restrictor portion 240 shown in FIG. 11. In this modification, a restrictor portion 270 has a slurry flow passage which is gradually reduced in cross section from an upstream end 271*a* to a narrowing portion 272 where the passage is constant and small in cross section, and then gradually increased in cross section toward a downstream end 271*b*. With this arrangement, a large pressure drop can be achieved similar to the foregoing restrictor portions 240, and further, since the change in cross section of the passage is gradual, an abrasion force of the slurry can be reduced.

While the present invention has been described in terms of the preferred embodiments, the invention is not to be limited thereto, but can be embodied in various ways without departing from the principle of the invention as defined in the appended claims.

What is claimed is:

1. A system comprising:

a first processing system for wet-grinding low grade coal to produce a ground coal slurry of particle size not greater than 3 mm;

a second processing system for applying an upgrading treatment to said ground coal slurry under a pressurized hydrothermal atmosphere not less than 300° C. to produce an upgraded coal slurry;

a third processing system for applying a dehydration treatment to said upgraded coal slurry to produce an upgraded coal cake and a filtrate, adding water and an additive to said upgraded coal cake and mixing them to produce a high-concentration coal-water slurry; and a fourth processing system for recycling said filtrate as water for producing said ground coal slurry;

wherein said first processing system comprises a wet grinder and a flotator arranged prior to said wet grinder, and wherein said filtrate produced in said third processing system is fed to said flotator for deashing said low grade coal using a foaming component in said filtrate.

2. The system according to claim 1, wherein said second processing system comprises a heating mechanism for heating said ground coal slurry, and said fourth processing system comprises a burning mechanism for burning an organic component contained in said filtrate to be removed, and wherein an exhaust gas discharged from said burning mechanism is fed to said heating mechanism for heating said ground coal slurry.

* * * * *